United States Patent [19]

Purcell

[11] Patent Number: 4,978,048

[45] Date of Patent: Dec. 18, 1990

[54] FASTENER SETTING MACHINE HAVING DOUBLE-ACTING DRIVE MEANS

[75] Inventor: Ricky W. Purcell, Gainesville, Ga.

[73] Assignee: Scovill Fasteners Inc., New York, N.Y.

[21] Appl. No.: 408,542

[22] Filed: Sep. 18, 1989

[51] Int. Cl.[5] ..... A41H 37/10; A41H 37/00; B21J 15/16; B21J 15/28

[52] U.S. Cl. ..... 227/149; 227/2; 227/152; 227/129; 227/130

[58] Field of Search ..... 227/2, 4, 19, 31, 51, 227/61, 62, 129, 130, 149, 152

[56] References Cited

U.S. PATENT DOCUMENTS

| | | | |
|---|---|---|---|
| 4,247,032 | 1/1981 | Stanik | 227/129 X |
| 4,645,110 | 2/1987 | Taga | 227/2 |
| 4,741,466 | 5/1988 | Birkhofer | 227/2 X |

*Primary Examiner*—Paul A. Bell
*Attorney, Agent, or Firm*—Dallett Hoopes

[57] ABSTRACT

Setting machine for fasteners has a double-acting air cylinder with a toggle linkage for driving down the upper die and an air cylinder for driving a wedge to drive up the lower die. The cylinders are activated to drive the dies together to set the fastener parts as pushers, which have moved the fastener parts into setting position, are retracted.

6 Claims, 3 Drawing Sheets

FASTENER SETTING MACHINE HAVING DOUBLE-ACTING DRIVE MEANS

BACKGROUND OF THE INVENTION

This invention relates to fastener setting machine, sometimes called a fastener attaching machine. More specifically, the invention relates to a setting machine having pneumatic drive means for both the upper and lower dies, the upper die being driven by a double acting air cylinder by means of a toggle linkage.

Description of Related Art including Information Disclosed under §§1.97 to 1.99

In the prior art there are scores of attaching machines by which a snap fastener or button or rivet, for instance, can be attached to a garment. The bulk of these machines are driven by a rotary fly wheel activating through a clutch, a descending plunger carrying an upper die. In the attaching process the clutch is engaged and the rotary power of the rotating fly wheel is connected to a plunger drive linkage which powers down the plunger carrying the upper die downward along with its upper fastener part toward the lower die which carries the lower fastener part. The parts interengage the fabric of the garment, for instance, inbetween.

Such rotary drive means has also taken the form of a motor having a continuous rotating shaft which is engaged with a fly wheel through a clutch, the fly wheel eccentrically mounting a linkage adapted to drive the setting plunger. An assembly of such structure is disclosed in the U.S. Pat. No. 4,741,466 which issued May 3, 1988 to Herbert Birkhoffer, and assigned my assignee.

The drive arrangement disclosed in the patent, while meritorious, is somewhat complicated and expensive to manufacture.

SUMMARY OF THE INVENTION

The present invention is involves the use of air cylinders to drive both the upper and lower dies as well as the pusher elements which move the fastener parts into the die jaws. The drive arrangement for the upper die is a double-acting air cylinder which drives by means of toggle linkage.

BRIEF DESCRIPTION OF THE DRAWINGS

Other features and objects of the invention will be apparent in a study of the following specification with reference to the drawings, all of which disclose non-limiting embodiments of the invention. In the drawings.

DESCRIPTION OF THE PREFERRED EMBODIMENT

Figure 1:
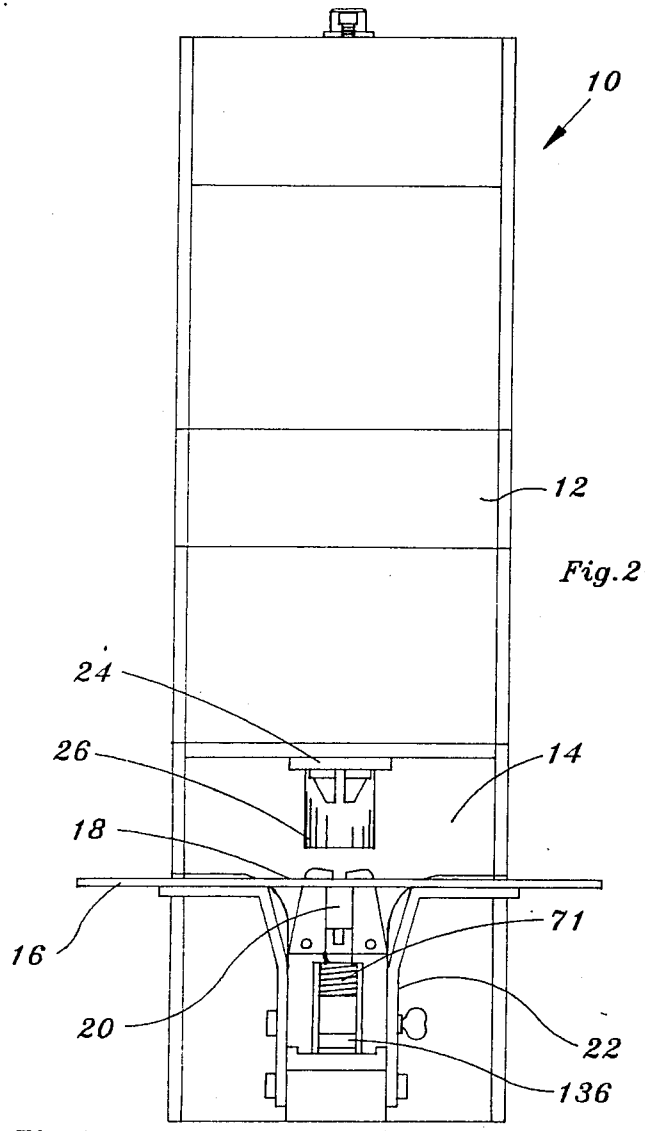
FIG. 1 is a front elevational view of a setting machine embodying the invention.

An attaching machine emobodying the invention is shown in FIG. 1 and generally designated 10. It comprises a housing 12 having a throat 14 in the lower portion of which is disposed a gauge plate 16 having a suitable opening 18 for the lower die 20 and lower die assembly 22. An upper die assembly 24 is in alignment thereabove and a tubular transparent finger guard 26 fixedly surrounds the accessible parts of the upper die assembly.

The upper die assembly 24 and lower die assembly 22 are conventional in all respects and comparable to those of the setting machine model 7057E, a rotary/clutch drive machine, available from my assignee.

More specifically, the upper die assembly comprises a tubular head 28 having a central bore 30. A pair of horizontally aligned set screws 32 extend through the head 28 and into the opening 30 to provide stop elements **32*a*. A floating plunger sleeve 34 is disposed reciprocably in the opening 30 and is formed intermediate its ends with opposed longitudinal slots 35**.

The lower end of the plunger sleeve carries an annular receiver 36 with radially outwardly extending pins 38 adjacent its lower end. The outward ends of the pins are received into radial openings 40 in upper jaws 42 respectively . Disposed inside the plunger sleeve 34 is a plunger 44, the upper end of which may be formed with a transverse opening 46 for purposes which will appear.

The plunger is reduced in diameter as at 48 and is provided with a friction spring 50 which is fixed longitudinally on the plunger by snap ring 52 fitting into a peripheral groove on the plunger and extending outward to form a shoulder immobilizing the bottom end of the friction sleeve 50. The lower end of the plunger 44 is formed with a central upward bore which receives the upper end of the die 56. The die is formed with a shoulder 58 for reasons which will appear.

The jaws 42 are formed with an upwardly facing stop 60 which limits the upward travel of the jaws as it engages the undersurface of the tubular head 28. The jaws are biased closed by a surrounding spring 61.

Figure 3:
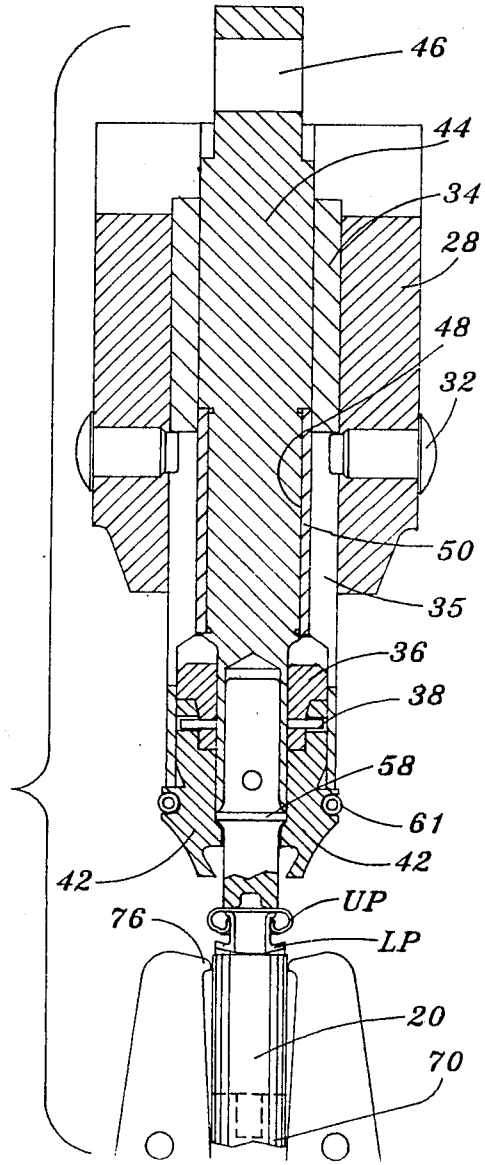
FIG. 3 is a view similar to FIG. 2 but showing the upper and lower dies closing.
Figure 2:
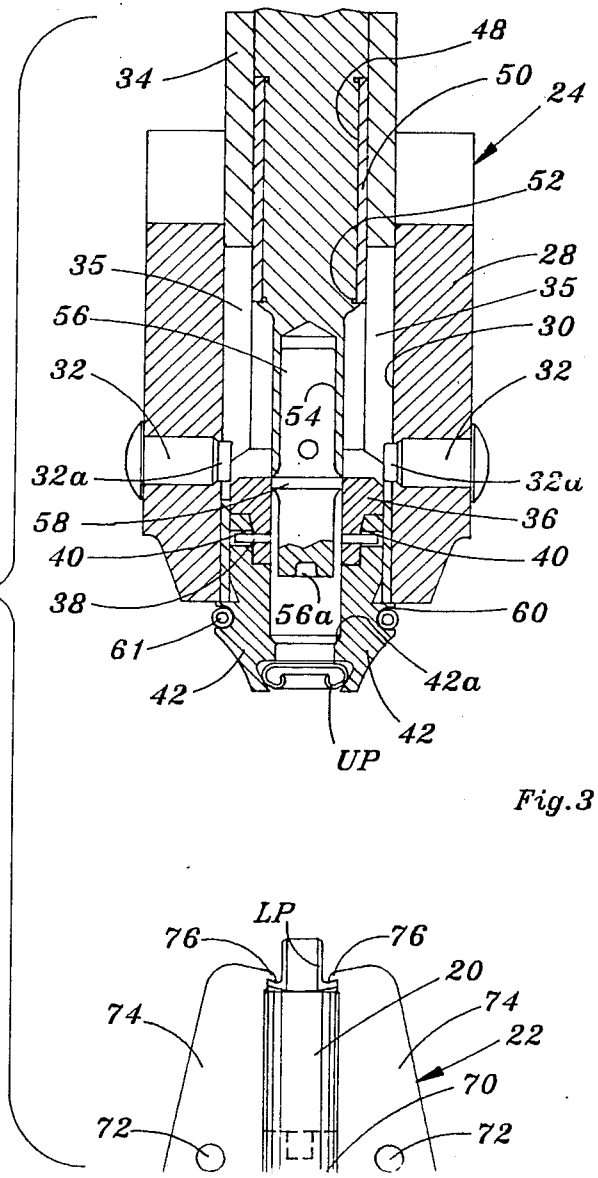
FIG. 2 is a sectional view of the upper and lower die assemblies showing some of the parts in a fragmentary sectional view.

As a result of the structure shown in FIGS. 2 and 3, the plunger 44 may be driven downward so that the lower end **56*a* of the die engages the upper fastener part UP to drive it downward toward the lower die. The downward motion continues until the shoulder 58 (FIG. 3) engages the cam surface 42*a* on the inside of the jaws 42 to open the jaws and permit the upper fastener part UP to move downward free of the jaws and engage the lower fastener part LP (FIG. 3). The setting of the part itself forms the stop for the lower travel of the plunger 44**.

The lower die assembly 22 comprises the lower die 20, the upper face of which is shaped to hold the bottom of the lower fastener part LP. The upper die 20 is supported suitably by a lower die holder 70 which may be biased downwardly by means not shown so that the lower die 20 always returns to its lower position. The holder 70 has mounting means not shown for pivot pin 72 on the opposite sides of the shoulder and which pivotally support the upward jaws 74 which extend up along the lower die 20.

The upper end of each of the jaws 74 are formed with inward fingers 76 which are angled upwardly and inwardly and are adapted to hold the lower fastener part LP in position on the lower die 20. The upper end jaws are biased inwardly. As the setting operation advances, the holder 70 slides upward with respect to the jaws 74 so that the lower die 20 drives the lower fastener part upward. The lower die 20 forces the fastener part LP to cam outward the undersurface of the fingers 76 to permit the part LP to escape upward out of the jaw 74 ready for setting with the upper part UP, the fabric of the garment (not shown) inbetween.

It is understood that the upper fastener part UP and the lower fastener part LP are moved laterally prior to the setting action into the spaces between the jaws 42 and 74 where the parts are shown engaged.

Figure 5:
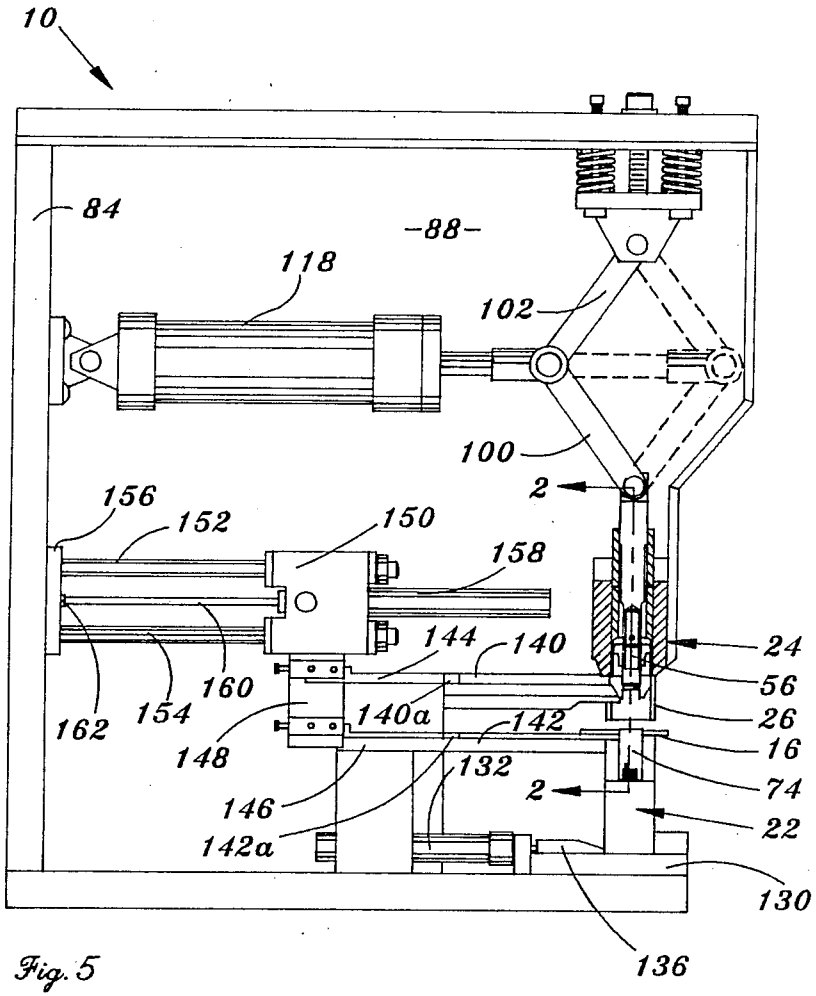
FIG. 5 is similar to FIG. 4 but showing the toggle linkage in its retracted condition (alternately in phantom) with the upper die in its upward position.
Figure 4:
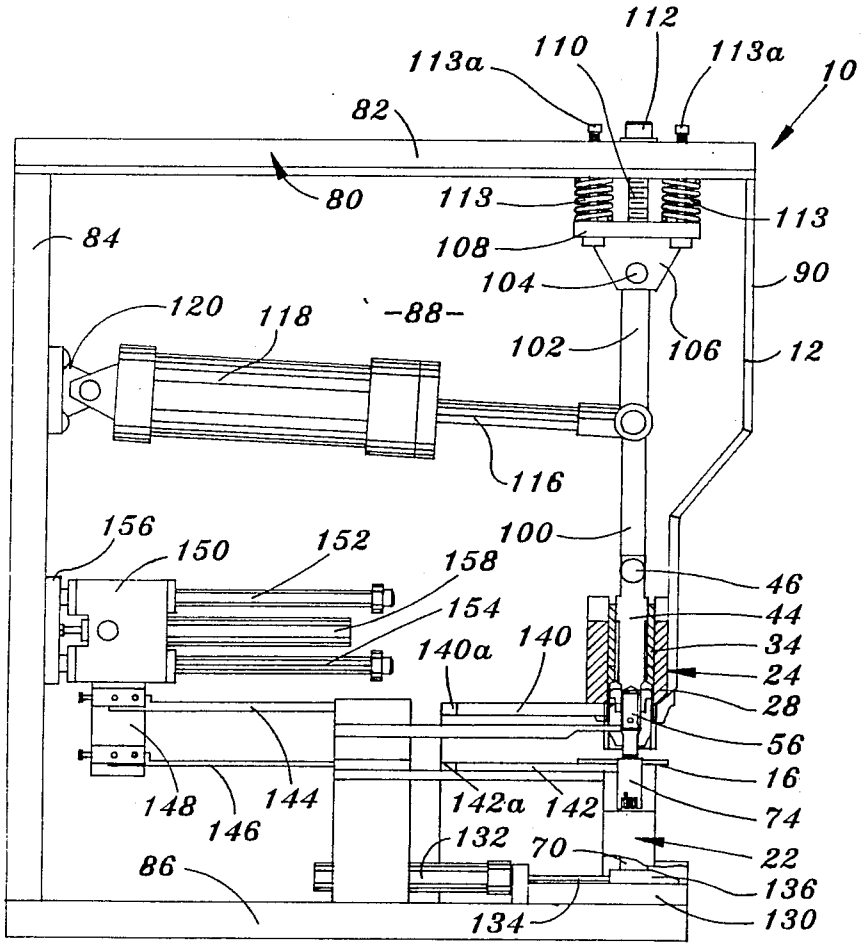
FIG. 4 is a side elevational view with the cover removed of the setting machine shown in FIG. 1 and showing the upper die in its lower position with the toggle linkage extended.

Reference is now made to FIGS. 4 and 5 showing the drive means for the upper and lower die and the parts feature. The housing 12 encloses a C-shaped frame 80 having an upper wall 82, a rear wall 84 and a bottom wall 86, the latter being supported on a stand (not shown). A side wall 88 may lend additional strength to the C-shaped frame to keep it rigid, and a front wall 90 presents a throat 14 (FIG. 1). As shown, the lower die assembly 22 is mounted in the throat 14 and the upper die assembly 24 is mounted thereabove. The plunger 44 is disposed within the tubular head 28 as described above.

Secured by a pin extending through the opening 46 at the upper end of the plunger 44 is a first toggle link 100. A second toggle link 102 is secured by a pin 104 to a pad 106. The upper end of the pad 106 is provided with a horizontal base 108 which is suitably drilled and tapped to receive an adjusting bolt 110 which may be rotated by its head 112 which is supported on the upper portion 82 of the frame.

The vertical position of the pad 106 may be set, therefore, by merely turning the head 112 of the bolt. This will determine the pitch or travel of the plunger 44, as will be explained. The ends of the links 100 and 102 which are opposite the hole 46 and the pin 104 respectively are pivotally joined together by a toggle pin 114 which is connected to the distal end of a connecting rod 116 of the air cylinder 118. The housing of the cylinder 118 is pivotally attached as shown to the pad 120 secured to the rear wall 84 of the frame 80.

Compression developed by the plunger 44 on its downward stroke may be controlled by adjusting helical springs 113 which rest on the upper end of the base 108 of pad 106. Adjusting screws **113*a* are threaded into the upper wall 82 and their downward ends bear against individual discs (not shown) which cover the top of the springs 113. As a result of this structure, the lowermost position of the pad 106 during the stroke of the plunger 44 is controlled by the bolt 110, 112, and the resistance to upward movement 106 is controlled by adjusting the bolts 113*a* which fixes the compression of the springs 113**.

Referring to FIG. 5 the links 100 and 102 can toggle in and out as shown in the full and dotted line positions as the piston within the cylinder 118 advances and retracts. It will be clear that when the piston within the cylinder housing 118 is intermediate its extremes, the links 100 and 102 will extend in a straight line so that the upper die 56 is in its downwardmost setting position. Conversely when the piston within the housing 118 is at either end of its stroke, the upper die 56 will be at its uppermost position. As the piston within housing 118 approaches its extremes (FIG. 5) the shoulder 58 on the upper die will be camming the jaws 42 outward to release the part UP, as explained.

Attention is now focused on the lower portion of FIGS. 4 and 5 wherein the bottom wall 86 is provided with a wedge shelf 130 fixedly mounted and adjacent is a cylinder 132, the housing of which contains a piston connected to a rod 134 which terminates in a wedge 136. The holder 70 is part of the lower die assembly 22 and supports the lower die 20. The lower die 20 and the holder 70 are biased downwardly by spring means 71.

As a result of the structure thus far described, the extension of the connecting rod 134 by the piston within the cylinder housing 132 causes the wedge to drive outwardly as shown, raising the lower die holder 70. Conversely when the piston within the housing 32 retracts, the wedge 136 withdraws from its position under the die holder 70 and permits the lower die 20 to be urged down to the position shown by spring 71 in FIG. 1.

Focusing now on the area above the cylinder housing 132, in FIGS. 4, 5, it will be seen that a pair of spaced horizontal tracks 140 and 142 are mounted to direct fastener parts into the upper jaws 42 and the lower jaws 74 respectively when the plunger 44 is up and the wedge 136 is withdrawn. At this point, elongate pushers 144 and 146 operate in the respective tracks 140 and 142 after single parts have been dispensed therein through gates **140*a* and 142*a*** from supply means not shown.

The means for driving the pushers 144 and 146 comprise a downward bracket 148 on which the fingers 144 and 146 are adjustably mounted as shown. The bracket is secured to the bottom of a travelling head 150 which is formed with a pair of spaced parallel bores receiving the rods 152, 154 secured in the bed plate 156. The bed plate 156 is, in turn, secured to the rear wall 84.

Central in the head 150 is mounted an air cylinder 158 having a connecting rod 160, the outer end of which 162 is fixed in the bed plate 156. By virtue of this structure, when the piston within the cylinder housing 158 is extended, the head 150 is moved outward on the rods 152 and 154 (FIG. 5). Conversely, when the piston with the cylinder housing is retracted on its rod 160 the head 150 will move leftward to the position shown in FIG. 4. Accordingly, the pushers 144 and 146 will extend into or be withdrawn from the tracks 140 and 142. The head 150 together with the associated parts are available as an off-the-shelf assembly from Ultramation of Waco, Tex.

OPERATION OF PREFERRED EMBODIMENT

It will be understood that the pneumatic hoses leading to the cylinders 118, 158 and 132 are not shown to avoid complication of the drawings. Pressure through these lines connecting them to a source may be controlled electrically by activating solenoid valves as is well known in the art. The electric timing may be programmed by a programmable computer well known in the art and available, for instance, from General Electric under the name "Series 1" or Allen Bradley Company.

Greatly simplified, and ignoring the fastener part supply hopper controls, the various electrical safeguards and so on, the sequence of operation is quite simple.

The operator initiates the setting process by pressing a foot pedal or the like. The pushers 144, 146 will move leftward as the cylinder 158 causes the piston rod 160 to retract. When the pushers are retracted to a point at which the head 150 trips a limit switch (not shown), that switch will cause the activation of cylinder 118 to drive to its opposite position and cylinder 132 to drive rightward showing the wedge 136 under the lower die. Both dies will thereby be brought together to make the attachment.

Thereafter, the cylinder 118 having arrived at its opposite position, the cylinder 132 retracts the wedge 136 and both dies are in their mutually most-remote positions. Meanwhile the pushers 144, 146 will come on back past the gates 140*a* and 142*a* in communication with supplies (not shown) to pick up the next round of fastener parts, and bring the parts forward to the upper and lower die assemblies. The sequence for the next attachment is now ready to commence.

TANDEM EMBODIMENT

Figure 6:
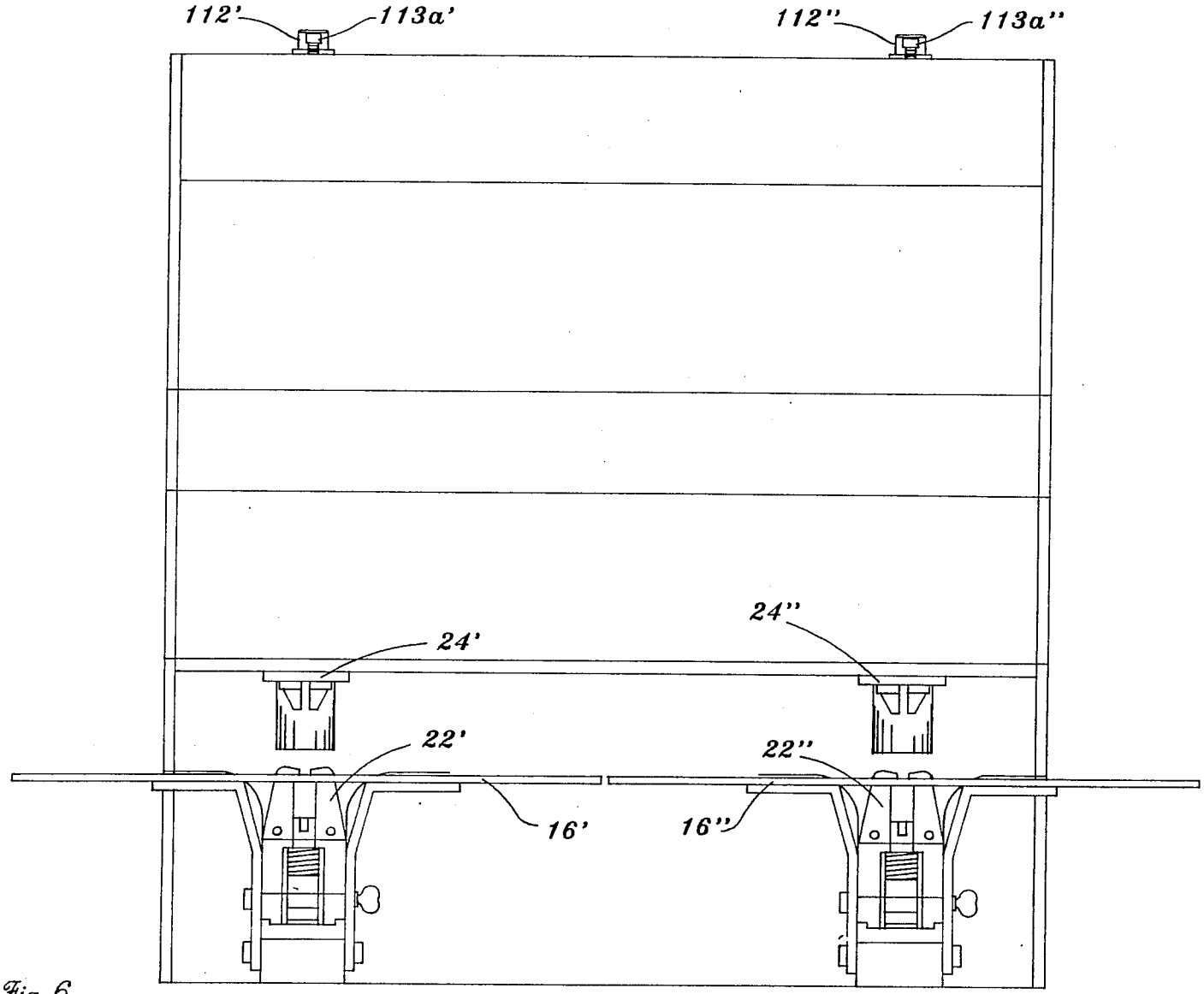
FIG. 6 is an elevational view of a double-headed version of the setter shown in FIGS. 1 through 5.

If desired or necessary, a pair of assemblies as shown in FIGS. 4 and 5 may be set up side-by-side within the same frame (FIG. 6). If desired, the supply tracks 40, 42 (as shown in FIGS. 4 and 5) may be connected to supply sources separate for each of the two units. For instance, the upper die assembly 24' on the left hand unit (FIG. 6) may be connected to a source of snap fastener studs while the lower die assembly 22' may be connected to a source of snap fastener posts. Similarly the track of the upper die assemby 24'' of the right hand unit (FIG. 6) may be attached to a source of anvil buttons while the lower die assembly 22'' may be connected to a source of tacks.

It will be clear that in the tandem embodiment the operator may selectively actuate the right hand or the left hand attaching assembly after he or she places the fabric (not shown) on the gauge plate 16' or 16'' as shown and may selectively set either the socket or the button from the supply system described above. Thus the tandem or double system of FIG. 6 gives added speed and flexibility to the setting operation and permits different functions to be accomplished by the same operator without requiring the floor space of separate setting machines.

It will be understood that many variations of the arrangements described above are possible, all within the scope of the following claim language which, together with reasonable equivalents thereof, defines the invention.

What is claimed is:

1. An attaching machine for attaching fastener parts to a garment or the like comprising:

a. a frame;

b. an upper die mounted for vertical reciprocation on the frame;

c. a lower die mounted for vertical reciprocation on the frame beneath and in cooperation with the upper die;

d. a pair of generally vertical toggle drive links pivotally linked together at a joint, the upper end of the pair pivotally secured to the frame, the lower end pivotally secured to the upper die assembly;

e. a toggle drive air cylinder having one end pivotally secured to the frame laterally of the toggle joint and the other end secured to the toggle joint;

f. a wedge support shelf under the lower die;

g. wedge means adapted to reciprocate horizontally between the lower die assembly and the shelf to raise the lower die;

h. a wedge air cylinder having one end connected to the frame and the other end connected to the wedge; and i. first air supply control means for supplying air to the air cylinders in sequence so that when the toggle drive is in the middle of either its extending or retracting stroke to lower the upper die to its lowest point of travel, the wedge is in a position at which the lower die assembly is raised to its upper point of travel and when the toggle drive is at the ends of its stroke, the wedge is in a position at which the lower die is lowered to its lower point of travel.

2. An attaching machine as claimed in claim 1 including additionally straight tracks for supporting the travel of fastener parts to the upper and lower dies respectively and pushers for moving the parts into the respective dies and a pusher power assembly and second timed air supply control means for supplying air to the pusher power assembly in sequence with the first timed air supply control means so that the pushers move the parts to the respective dies when the toggle drive is at one end of its travel or the other.

3. An attaching machine as claimed in claim 1 wherein the pusher power assembly comprises a pair of spaced horizontal rods secured to the frame, a head reciprocable on the rods, a pneumatic piston/cylinder unit operatively secured between the frame and the head, the pushers being spaced horizontal elongate elements disposed in the tracks respectively.

4. An attaching machine as claimed in claim 1 wherein a lower die assembly comprises a vertically disposed lower die, a lower die holder, a pair of jaws disposed on opposite sides of the holder and pivoted thereto about horizontal axes, the jaws extending upward over the lower die to hold a lower fastener part thereon during setting, the die being raised by the wedge, pushing the jaws aside after setting.

5. An attaching machine as claimed in claim 1 wherein an upper die assembly comprises a fixed tubular head surrounding a die plunger, surrounding the upper die held in the lower end of the plunger, a plunger sleeve intermediate the plunger and tubular head and frictionally associated with the plunger, a pair of upper jaws carried by the plunger sleeve and adapted to hold an upper fastener part below the die until the die lowers, spreading the upper jaws to drive the upper part into engagement with a lower part.

6. An attaching machine as claimed in claim 1 wherein on a single frame items b through i are duplicated to provide side-by-side attaching stations.

* * * * *